US006939113B2

(12) United States Patent
Otsuka et al.

(10) Patent No.: US 6,939,113 B2
(45) Date of Patent: Sep. 6, 2005

(54) FAN WITH INCREASED AIR FLOW

(75) Inventors: Shuichi Otsuka, Miyota-Machi (JP); Jinko Ikeda, Miyota-Machi (JP)

(73) Assignee: Minebea Co., Ltd. (JP)

( * ) Notice: Subject to any disclaimer, the term of this patent is extended or adjusted under 35 U.S.C. 154(b) by 0 days.

(21) Appl. No.: 10/413,021

(22) Filed: Apr. 14, 2003

(65) Prior Publication Data

US 2004/0037720 A1 Feb. 26, 2004

(30) Foreign Application Priority Data

Apr. 17, 2002 (JP) ..... 2002-115103

(51) Int. Cl.[7] ..... F04D 25/08
(52) U.S. Cl. ..... 417/354; 417/423.14
(58) Field of Search ..... 417/353, 354, 417/423.14, 423.15

(56) References Cited

U.S. PATENT DOCUMENTS 2,926,838 A * 3/1960 Van Rijn ..... 417/354
3,378,192 A * 4/1968 Friese ..... 417/353
3,644,066 A * 2/1972 Heob et al. ..... 417/354
4,225,285 A * 9/1980 Sturm ..... 417/354
6,158,985 A * 12/2000 Watanabe et al. ..... 417/423.14
6,659,737 B2 * 12/2003 Bader et al. ..... 417/423.14
2002/0028146 A1 * 3/2002 Otsuka ..... 417/354
2003/0152466 A1 * 8/2003 Sung ..... 417/354

FOREIGN PATENT DOCUMENTS

DE 4127134 A1 * 2/1993

* cited by examiner

*Primary Examiner*—Michael Koczo, Jr.
(74) *Attorney, Agent, or Firm*—Schulte Roth & Zabel, LLP

(57) ABSTRACT

A fan with increased air flow having a casing in which an air passage hole is formed. A motor is connected to this casing and is held in the center of the air passage hole by a motor base positioned within the air passage hole. Multiple blades are rotated by the motor and covey air from the air passage hole intake port side to the exhaust port side. The annular outer wall of the fan is inclined with respect to the center axis towards the air passage hole exhaust port. By this means, a fan is capable of attaining a greater airflow volume than conventional fans, while having the same outward shape as a conventional fan.

5 Claims, 6 Drawing Sheets

FAN WITH INCREASED AIR FLOW

CROSS-REFERENCE TO RELATED APPLICATIONS

This application claims all rights of priority to Japanese Patent Application Serial No. JP 2002-115103, filed Apr. 17, 2002 (pending).

BACKGROUND

The invention relates to a fan used to exhaust heat generated, for example, in an enclosure for electronic equipment.

In electronic equipment in which a large number of electronic parts are housed in a relatively small enclosure, such as personal computers, copy machines or other office automation equipment, the heat generated by the above electronic parts builds up in the enclosure, and there is a danger of heat induced failure of the electronic parts.

Air passages are therefore provided on the walls or top surfaces of electronic equipment enclosures, allowing the heat inside such enclosures to be exhausted to the outside by installing a fan in those air passages.

A conventional fan of this type is shown in FIGS. 4 and 5. FIG. 4 is a vertical section of the conventional fan. FIG. 5 is a left side view of FIG. 4. FIG. 4 shows a linear section along the line that connects the points C-O-D in FIG. 5. In both figures, reference number 1 designates a casing, with an air passage hole 1*a* formed in the center portion thereof. A motor base 4 is affixed in the center portion of the air passage hole 1*a* in the casing 1 by means of three ribs 3 which extend from the opening edge of the air passage hole 1*a*. A cylindrical bearing holder 5 is affixed in the center portion of the motor base 4. The outer rings of bearings 6 and 7 are mounted on the inside of the cylindrical bearing holder 5, and a motor rotation shaft 8 is inserted in and supported by the inner rings of the bearings 6 and 7. An impeller 10 comprises five blades 10*d* on the outer perimeter of an impeller main unit 10*c* having a cylindrical section 10*a* and a boss portion 10*b*. The impeller is joined to the top end of the motor rotation shaft 8. Blades 10*d* rotate around the shaft's axis as the shaft 8 rotates. A motor yoke 13 is mounted inside the impeller cylindrical section 10*a*, and a cylindrical permanent magnet 14 is affixed to the inner perimeter of the motor yoke 13. A stator winding 15 and iron core 16, are affixed to the outside of the bearing holder 5. Along with the motor yoke 13 and permanent magnet 14, the stator winding and the iron core form the main components of direct current motor DCM. A PC board 17 is attached to the stator iron core 16 in order to provide a specified current to the stator winding 15. This causes the stator winding 15, iron core 16, motor yoke 13 and permanent magnet 14 to operate as a brushless direct current motor DCM. On the motor base 4, the center axis 4*a* has an annular outer wall 4*b* positioned concentrically to the shaft 8. As shown in FIG. 4, the two edge surfaces of the ring-shaped outer wall 4*b* have the same diameter measurement, thus forming a cylinder. The fan described above is attached to the air passage holes in an office automation equipment enclosure.

When a direct current power source is supplied to the attached fan, a current controlled by the PC board 17 flows to stator winding 15, a magnetic flux is generated from the stator iron core 16, and the motor yoke 13 and blades 10*d* rotate due to the mutual magnetic effect of the stator iron core and the permanent magnet 14. As a result, air on the right side of the motor shown in FIG. 4 is pulled in and then is exhausted out of the left side of the motor shown in this figure, passing through the air passage hole 1*a*. Cooling of the enclosure interior is accomplished by this fan action.

A satisfactory air flow volume can to some extent be obtained even using such conventional technology as described above, but even a slight increase in air flow volume means a large effect in exhausting heat generated in electronic equipment enclosures to the outside.

SUMMARY OF INVENTION

The present invention provides a fan capable of increasing air flow volume without increasing external size.

In one aspect of the present invention, the fan comprises a casing having an air passage hole formed therein. A motor is connected to this casing and held in the center of the air passage hole by a motor base positioned within the air passage hole. Multiple blades of the fan rotate and covey air from the air passage hole intake port side to the exhaust port side. The annular outer wall on the center axis side is inclined toward the air passage hole exhaust port, thus achieving a greater increase in air flow without increasing the size of the fan. The best results are achieved when the inclination angle of the annular outer wall with respect to the annular outer wall center axis is set between 10° and 40°.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION OF PREFERRED EMBODIMENT AND THE DRAWINGS

Figure 1:
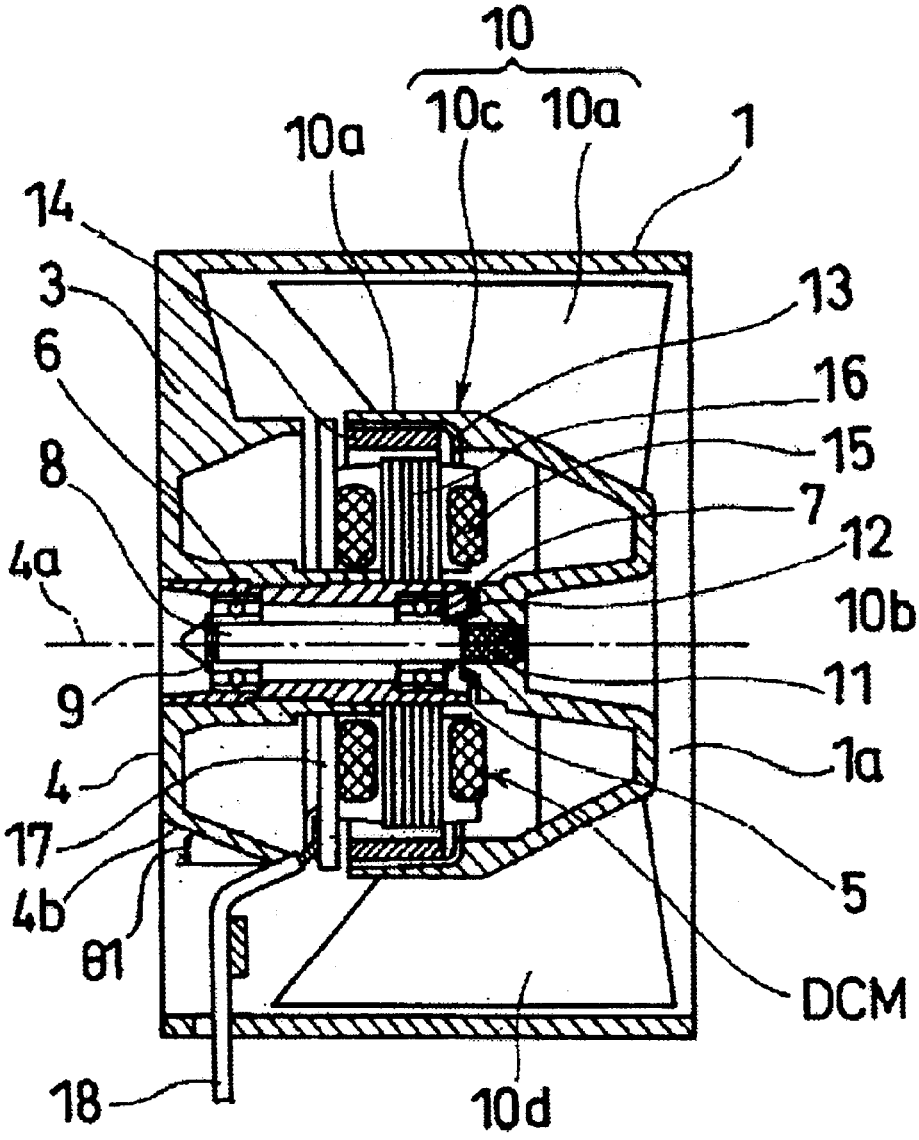
FIG. 1 is a vertical cross-sectional view showing an embodiment of a fan according to the present invention.
Figure 2:
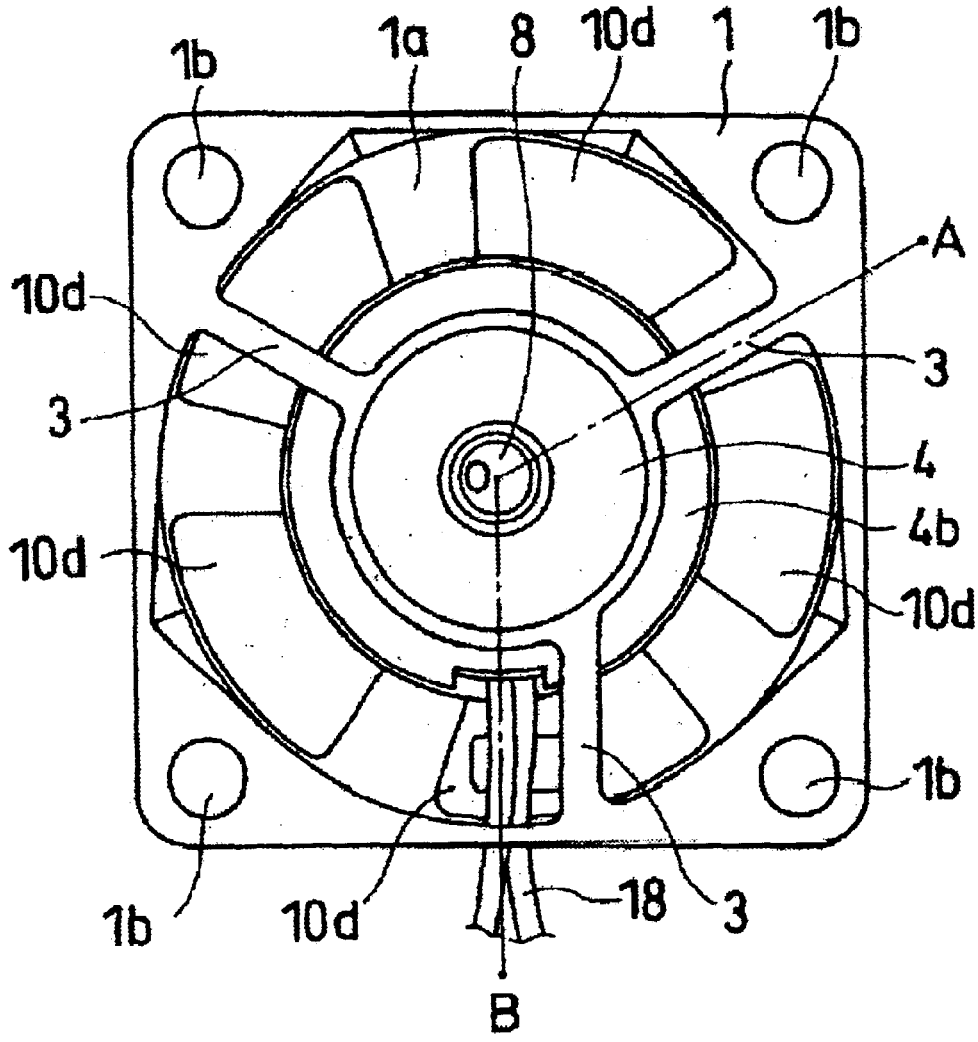
FIG. 2 is a left side view of the fan shown in FIG. 1.

FIGS. 1 and 2 show the preferred embodiment of the invention. FIG. 1 is a linear rendering of the section along the line connecting points A-O-B in FIG. 2.

In both figures, an approximately square shaped casing 1 is provided with a circular air passage hole 1*a* formed in the center portion thereof, and attachment holes 1*b* are provided at the four corners to attach the fan to the equipment enclosure. At the center portion inside the air passage hole 1*a* in casing 1, the motor base 4 is held in place by multiple ribs 3 which extend from different positions on the opening edges of the air passage hole 1*a*. The outer rings of two bearings 6 and 7 are spaced apart and are mounted inside the bearing holder 5. A motor rotation shaft 8 is inserted into and supported by the inner rings of bearings 6 and 7. A C-shaped retaining ring 9 is installed on the lower end of the shaft 8, thus preventing separation.

An impeller 10 comprises an impeller main unit 10*c*, which has a cylindrical section 10*a* and a boss portion 10*b*, and multiple blades 10*d*, which are provided at equidistant spacing on the outer perimeter of impeller main unit 10*c*. The impeller 10 is secured to the top end of shaft 8 using the boss portion 10*b* to position the shaft at the center of the cylindrical section 10*a* of main unit 10*c*, such that the blades 10*d* are caused to rotate around the shaft's axis when shaft 8 rotates.

A knurled knob 11 is etched into the joining portion between shaft 8 and boss portion 10*b* so as to increase the tightness of the connection when joining with the boss portion 10*b*. A coil spring 12 is interposed between the bearing 7 inner ring and the boss portion 10*b*, such that a deflecting force is imposed on the impeller 10. Further, a virtually cylindrical motor yoke 13 is set into and affixed to the inner perimeter of the impeller 10 cylindrical section 10*a*. A permanent magnet 14 is affixed to the inner perimeter of the motor yoke 13.

A stator iron core 16, around which the stator winding 15 is wound, along with the motor yoke 13 and permanent magnet 14, form the main components of a brushless direct current motor DCM. The iron core and its winding are affixed to the outside of the above-described bearing holder. A PC board 17, supplied with power from lead wire 18 and mounted with an electronic circuit, supplies a specified current to the stator winding 15 and causes the stator winding 15, stator iron core 16, motor yoke 13 and permanent magnet 14 to operate as a brushless direct current motor DCM.

The motor base 4 has an annular outer wall 4b such that the center axis 4*a* of he outer wall is positioned concentrically with the shaft 8. As shown in FIG. 1, this annular outer wall 4*b* is tapered so that it inclines toward the center axis 4*a* facing the outlet of the air passage hole 1*a*. In FIG. 1, the outer diameter of the annular outer wall 4*b* air passage hole 1*a* intake side is set to be approximately the same as the outer diameter of the cylindrical section 10*a* and PC board 17.

Figure 6:
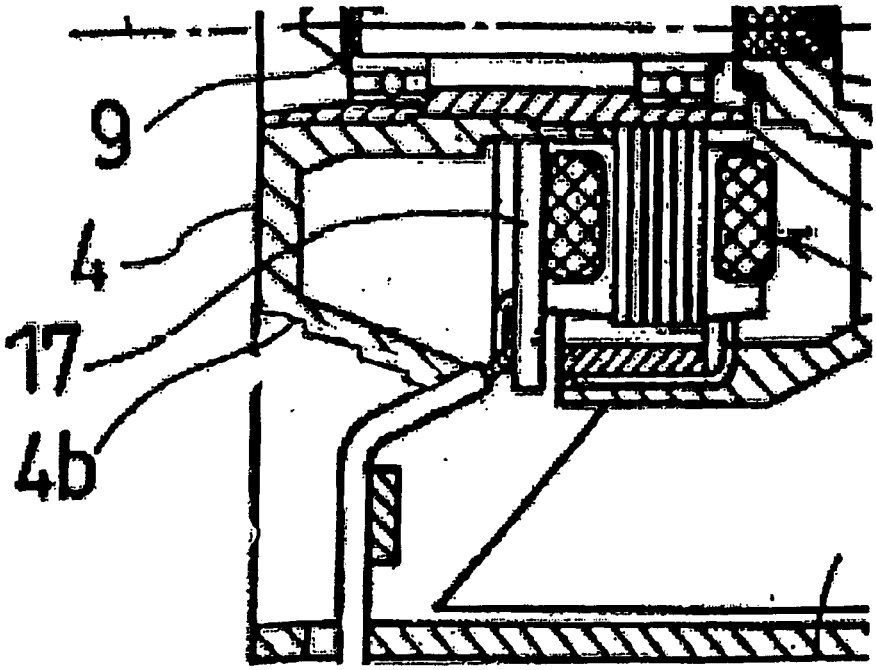
FIG. 6 is a cross sectional view of the annular outer wall 4*b* having a stepped shape.

Although the preferred embodiment of the invention is shown a having the tapered shape of the inclination of the annular outer wall 4*b* toward the center is 4*a* side, the wall can also be claw-or stepped-shaped (shown in FIG. 6). In sum, it is sufficient for the annular outer wall 4*b* to be shaped so that overall it inclines toward the center axis 4*a* side air passage hole 1*a* outlet opening.

The fan of the above-described constitution is used by attaching it to air passages in an office automation equipment enclosure. When direct current power at a specified voltage is supplied to lead 18 in this state, current controlled by the electronic circuit on the PC board 17 flows to the stator winding 15. A magnetic flux is thus generated in the stator iron core 16, and as a result, the motor yoke 13 and impeller 10 rotate around shaft 8; causing the blades 10*d* rotate. As a result, air on the right side of the fan shown in FIG. 1 is pulled in, and then exhausted through the air passage hole 1*a* to the left side of fan, as shown in the same figure. Cooling of the enclosure interior is accomplished by this fan action.

Figure 3:
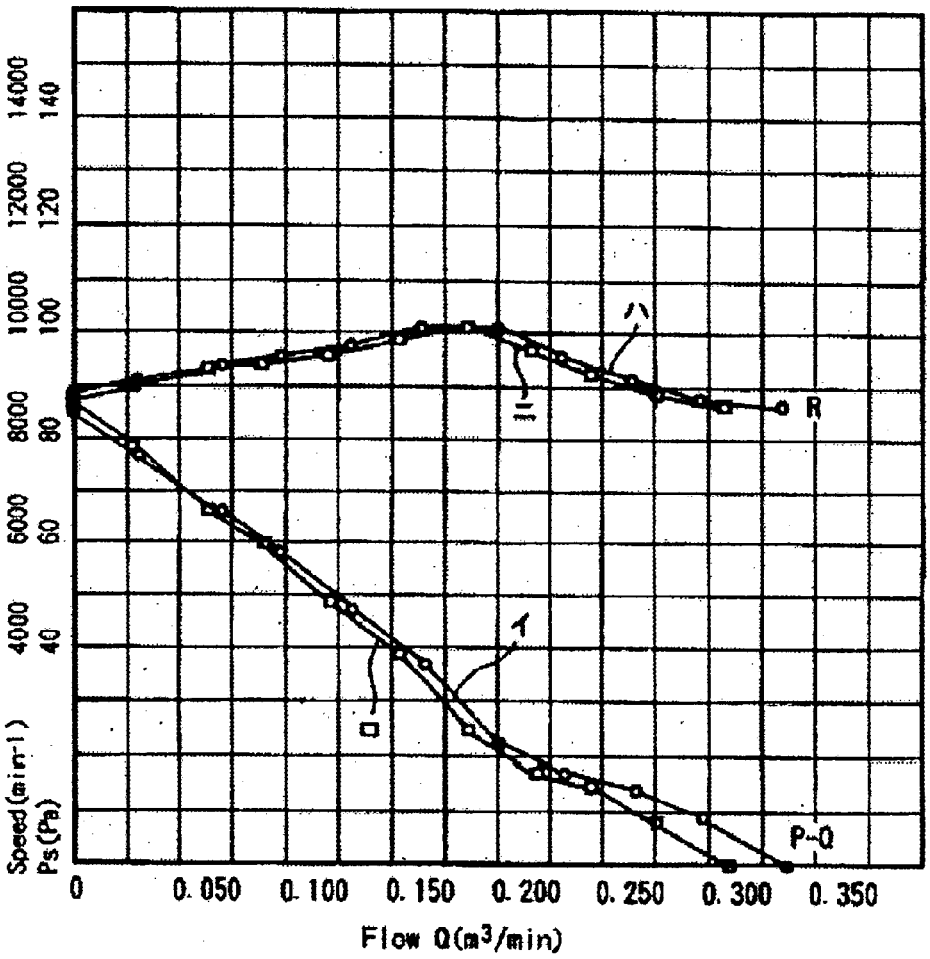
FIG. 3 is a graph showing the P-Q characteristics of a fan according to the present invention (axial flow) and of a conventional fan.
Figure 4:
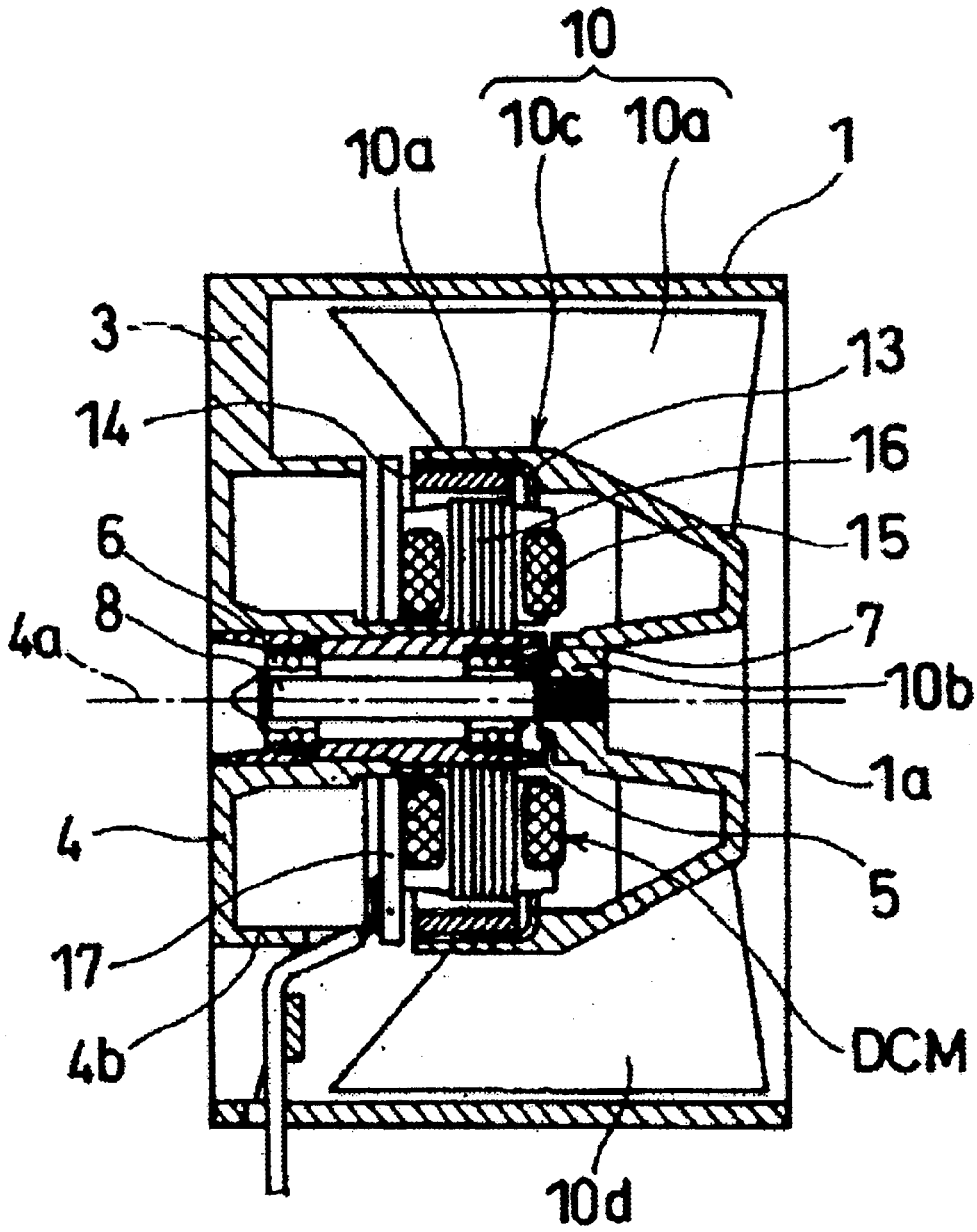
FIG. 4 is a vertical cross-sectional view of a conventional fan.
Figure 5:
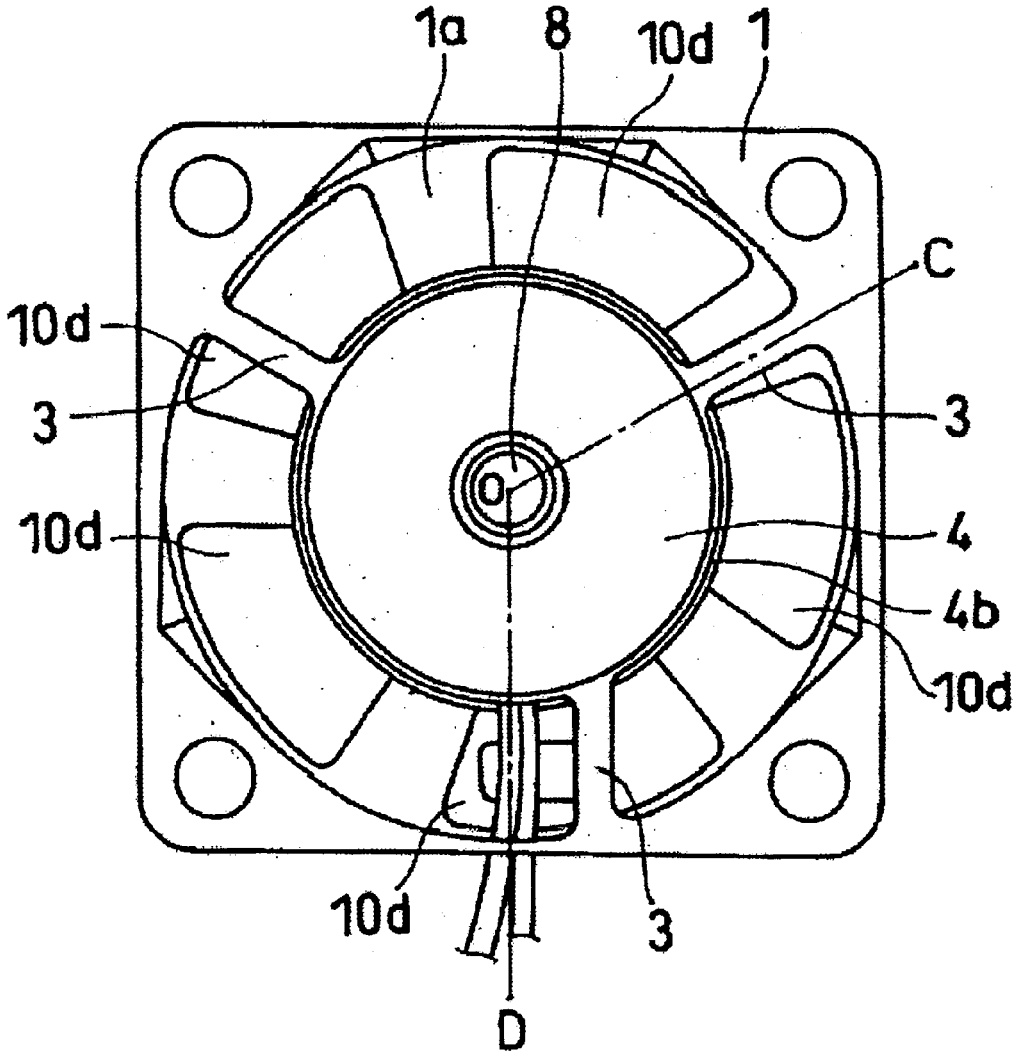
FIG. 5 is a left side view of the fan shown in FIG. 4.

FIG. 3 is a graph depicting the P (static pressure) and Q (air flow volume) characteristics of the fan of the preferred embodiment with those of the conventional fan shown in FIG. 4. Curve A shows the P-Q characteristics of the present invention product; curve B shows the P-Q characteristics of the conventional product. As can be seen from this graph, an increased air flow is observed in the present invention compared with the conventional fan's P-Q characteristics, particularly with respect to air flow volume.

In the preferred embodiment, the annular outer wall 4*b* is inclined toward the annular outer wall center axis 4*a* (shaft 8) facing the air passage hole 1*a* outlet port, and the air passageway inside the air passage hole 1*a* is formed so as to gradually widen from the annular outer wall 4*b* air passage hole 1*a* intake port side toward the exhaust outlet side. The air passage hole 1*a* exhaust outlet refers to the left side opening of the air passage hole 1*a* in FIG. 1. The opening on the opposite side thereof is the air passage hole 1*a* intake port, and the air flow path between those exhaust and intake openings is referred to as the air passageway. With the conventional product, on the other hand, as shown in FIG. 4, there is no inclination toward the center axis 4*a* (shaft 8) side of the motor base 4 annular outer wall 4*b*. With the presence of the inclination described above, an increase in air flow volume was observed. The most beneficial result was obtained over a range of inclination angles θ1 (see FIG. 1) of the annular outer wall 4*b* with respect to the annular outer wall center axis 4*a* between 10° and 40°.

In the preferred embodiment, an outer rotor type of motor was used to cause the blades to rotate. An inner rotor type of motor may also be used.

Also, in the preferred embodiment, the fan is used to exhaust heat inside an equipment enclosure, but it could also be used to bring outside air into the enclosure by reversing the air passage direction.

Furthermore, the preferred embodiment applied to an axial flow fan, but it could, for example, be used in a blower-type device.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

The invention claimed is:

1. A fan with increased air flow comprising:

a casing having a straight cylindrical wall, said straight cylindrical wall defining an air flow passage within the casing; and a motor having a rotating shaft with at least one blade mounted thereon and a motor base, said motor base further comprising a central portion with an annular wall and a plurality of ribs extending from said annular wall to said casing within said air flow passage and securing said motor to said casing;

wherein an outer surface of said annular wall is outwardly inclined with respect to an axis of the shaft such that an outer diameter of said motor base is gradually reduced in the direction of airflow, and wherein said ribs extending from said annular wall are downwardly inclined with respect to a bottom surface of said motor base in the direction of airflow.

2. A fan with increased air flow as recited in claim 1, wherein the motor is positioned in the center of the air flow passage.

3. A fan with increased air flow as recited in claim 1, wherein an inclination angle of the inclining outer surface of said annular outer wall is between 10° and 40°.

4. A fan with increased air flow as recited in claim 1, wherein the inclining outer surface of said annular outer wall comprises a stepped shape.

5. A fan with increased air flow as recited in claim 1, wherein the motor is an outer rotor type of motor.

* * * * *